US009644930B1

(12) United States Patent
Burrow

(10) Patent No.: US 9,644,930 B1
(45) Date of Patent: May 9, 2017

(54) METHOD OF MAKING POLYMER AMMUNITION HAVING A PRIMER DIFFUSER

(71) Applicant: True Velocity, Inc., Dallas, TX (US)

(72) Inventor: Lonnie Burrow, Carrollton, TX (US)

(73) Assignee: TRUE VELOCITY, INC., Dallas, TX (US)

( * ) Notice: Subject to any disclaimer, the term of this patent is extended or adjusted under 35 U.S.C. 154(b) by 10 days.

(21) Appl. No.: 14/921,441

(22) Filed: Oct. 23, 2015

Related U.S. Application Data

(60) Continuation-in-part of application No. 14/011,202, filed on Aug. 27, 2013, now Pat. No. 9,546,849, which is a division of application No. 13/292,843, filed on Nov. 9, 2011, now Pat. No. 8,561,543.

(60) Provisional application No. 61/456,664, filed on Nov. 10, 2010.

(51) Int. Cl.
*F42B 33/00* (2006.01)
*F42B 33/04* (2006.01)
*F42B 33/02* (2006.01)

(52) U.S. Cl.
CPC ..... *F42B 33/001* (2013.01); *F42B 33/0207* (2013.01); *F42B 33/04* (2013.01)

(58) Field of Classification Search
CPC .... F42B 5/26; F42B 5/285; F42B 5/28; F42B 33/001; F42B 33/0207; F42B 33/04; F42B 5/30; F42B 5/307
USPC ..... 102/430, 466, 467, 469, 468; 86/19.8, 86/11, 18
See application file for complete search history.

(56) References Cited

U.S. PATENT DOCUMENTS

| | | | | |
|---|---|---|---|---|
| 1,940,657 | A | 1/1933 | Woodford | |
| 2,294,822 | A * | 9/1942 | Albree | F42B 5/285 102/464 |
| 2,654,319 | A * | 10/1953 | Roske | F42B 5/307 102/467 |
| 2,862,446 | A | 12/1958 | Ringdal | |
| 3,099,958 | A | 8/1963 | Daubenspeck et al. | |
| 3,170,401 | A * | 2/1965 | Johnson | F42B 5/18 102/467 |
| 3,242,789 | A * | 3/1966 | Woodring | F42B 5/30 102/467 |
| 3,292,538 | A | 12/1966 | Umbach et al. | |
| 3,659,528 | A * | 5/1972 | Santala | F42B 5/28 102/464 |

(Continued)

FOREIGN PATENT DOCUMENTS

| | | |
|---|---|---|
| CA | 2813634 A1 | 4/2012 |
| DE | 16742 | 1/1882 |

(Continued)

OTHER PUBLICATIONS

Korean Intellectual Property Office (ISA), International Search Report and Written Opinion for PCT/US2015/038061 dated Sep. 21, 2015, 28 pp.

(Continued)

*Primary Examiner* — John D Cooper
(74) *Attorney, Agent, or Firm* — Chainey P. Singleton; Edwin S. Flores; Chalker Flores, LLP

(57) ABSTRACT

The present invention provides a polymeric ammunition having a polymeric cartridge, projectile and a primer insert having a primer diffuser cup with a primer inserted therein.

15 Claims, 7 Drawing Sheets

(56) References Cited

U.S. PATENT DOCUMENTS 3,745,924 A * 7/1973 Scanlon ..... F42B 5/36 102/467
3,797,396 A * 3/1974 Reed ..... F42B 5/285 102/464
3,874,294 A * 4/1975 Hale ..... F42B 33/001 102/467
3,955,506 A * 5/1976 Luther ..... F42B 5/307 102/467
3,977,326 A * 8/1976 Anderson ..... F42B 5/307 102/467
3,990,366 A * 11/1976 Scanlon ..... F42B 5/26 102/467
4,147,107 A * 4/1979 Ringdal ..... F42B 5/307 102/467
4,173,186 A * 11/1979 Dunham ..... F42B 29/00 102/430
4,187,271 A * 2/1980 Rolston ..... B29C 70/443 102/466
4,228,724 A 10/1980 Leich
4,475,435 A 10/1984 Mantel
4,718,348 A 1/1988 Ferrigno
4,719,859 A * 1/1988 Ballreich ..... F42B 8/04 102/444
4,726,296 A * 2/1988 Leshner ..... F42B 5/307 102/430
5,021,206 A 6/1991 Stoops
5,033,386 A * 7/1991 Vatsvog ..... F42B 5/307 102/430
5,063,853 A * 11/1991 Bilgeri ..... F42B 5/307 102/444
5,151,555 A 9/1992 Vatsvog
5,165,040 A * 11/1992 Andersson ..... F42B 5/29 102/430
5,237,930 A 8/1993 Belanger et al.
5,259,288 A 11/1993 Vatsvog
5,563,365 A * 10/1996 Dineen ..... F42B 5/181 102/430
5,950,063 A 9/1999 Hens et al.
5,961,200 A 10/1999 Friis
5,969,288 A * 10/1999 Baud ..... F42B 5/313 102/466
6,004,682 A 12/1999 Rackovan et al.
6,272,993 B1 8/2001 Cook et al.
6,357,357 B1 * 3/2002 Glasser ..... F02K 9/70 102/374
6,460,464 B1 10/2002 Attarwala
6,523,476 B1 * 2/2003 Riess ..... F42B 5/181 102/431
6,649,095 B2 11/2003 Buja
6,752,084 B1 6/2004 Husseini et al.
6,845,716 B2 1/2005 Husseini et al.
7,059,234 B2 6/2006 Husseini
7,165,496 B2 * 1/2007 Reynolds ..... F42B 5/045 102/469
7,204,191 B2 4/2007 Wiley et al.
7,213,519 B2 5/2007 Wiley et al.
7,392,746 B2 7/2008 Hansen
7,441,504 B2 10/2008 Husseini et al.
7,585,166 B2 9/2009 Buja
7,610,858 B2 11/2009 Chung
7,750,091 B2 7/2010 Maljkovic et al.
8,408,137 B2 4/2013 Battablia
8,443,730 B2 5/2013 Padgett
8,522,684 B2 9/2013 Davies et al.
8,561,543 B2 * 10/2013 Burrow ..... F42B 5/307 102/466
8,573,126 B2 * 11/2013 Klein ..... F42B 5/307 102/430
8,689,696 B1 4/2014 Seeman et al.
8,763,535 B2 7/2014 Padgett
8,790,455 B2 7/2014 Borissov et al.
8,807,008 B2 8/2014 Padgett et al.
8,813,650 B2 8/2014 Maljkovic et al.
D715,888 S 10/2014 Padgett
8,869,702 B2 10/2014 Padgett
8,875,633 B2 11/2014 Padgett
8,978,559 B2 3/2015 Davies et al.
9,032,855 B1 5/2015 Foren et al.
9,091,516 B2 7/2015 Davies et al.
9,200,880 B1 12/2015 Foren et al.
2001/0013299 A1 8/2001 Husseini et al.
2003/0217665 A1 11/2003 Rennard
2005/0005807 A1 1/2005 Wiley
2005/0056183 A1 3/2005 Meshirer
2005/0188883 A1 9/2005 Husseini et al.
2005/0257711 A1 11/2005 Husseini et al.
2005/0257712 A1 11/2005 Husseini et al.
2006/0207464 A1 9/2006 Maljkovic et al.
2007/0214992 A1 * 9/2007 Dittrich ..... F42B 5/36 102/469
2009/0183850 A1 7/2009 Morrison et al.
2009/0314178 A1 * 12/2009 South ..... F42B 5/26 102/467
2010/0016518 A1 1/2010 El-Hibri et al.
2010/0300319 A1 12/2010 Guindon
2010/0305261 A1 12/2010 Maljkovic et al.
2011/0016717 A1 1/2011 Morrison et al.
2011/0179965 A1 7/2011 Mason
2012/0024183 A1 2/2012 Klein
2012/0111219 A1 * 5/2012 Burrow ..... F42B 5/307 102/467
2012/0180687 A1 7/2012 Padgett et al.
2013/0014664 A1 * 1/2013 Padgett ..... F42B 5/313 102/439
2013/0180392 A1 7/2013 Nuetzman et al.
2014/0060372 A1 3/2014 Padgett
2014/0060373 A1 3/2014 Maljkovic et al.
2014/0076188 A1 3/2014 Maljkovic et al.
2014/0216293 A1 8/2014 Klein et al.
2014/0235784 A1 8/2014 Maljkovic et al.
2014/0260925 A1 9/2014 Beach et al.
2014/0373744 A1 12/2014 Padgett et al.
2015/0033970 A1 2/2015 Maljkovic et al.
2015/0075400 A1 3/2015 Lemke et al.
2015/0241183 A1 8/2015 Padgett et al.
2015/0241184 A1 * 8/2015 Burrow ..... F42B 5/307 102/466
2015/0260490 A1 * 9/2015 Burrow ..... F42B 5/307 102/467
2015/0260491 A1 * 9/2015 Burrow ..... F42B 5/307 102/466
2015/0260495 A1 9/2015 Burrow
2016/0003587 A1 * 1/2016 Burrow ..... F42B 5/307 102/466
2016/0003588 A1 * 1/2016 Burrow ..... F42B 5/307 102/466
2016/0003589 A1 * 1/2016 Burrow ..... F42B 5/307 102/467
2016/0003590 A1 1/2016 Burrow
2016/0003593 A1 1/2016 Burrow
2016/0003594 A1 1/2016 Burrow
2016/0003595 A1 1/2016 Burrow
2016/0003596 A1 1/2016 Burrow
2016/0003597 A1 1/2016 Burrow
2016/0003601 A1 * 1/2016 Burrow ..... F42B 5/307 102/467

FOREIGN PATENT DOCUMENTS

EP 2625486 A1 8/2013
GB 783023 8/1955
WO 0034732 6/2000
WO 2007014024 A2 2/2007
WO 2012047615 A1 4/2012
WO 2012097317 A2 7/2012
WO 2012097320 A1 7/2012
WO 2013070250 A1 5/2013
WO 2013096848 A1 6/2013

(56) References Cited

FOREIGN PATENT DOCUMENTS

| | | | |
|---|---|---|---|
| WO | 2014062256 | A2 | 4/2014 |
| WO | 2016003817 | A1 | 1/2016 |

OTHER PUBLICATIONS

Korean Intellectual Property Office (ISA), International Search Report and Written Opinion for PCT/US2011/062781 dated Nov. 30, 2012, 16 pp.

* cited by examiner

METHOD OF MAKING POLYMER AMMUNITION HAVING A PRIMER DIFFUSER

CROSS-REFERENCE TO RELATED APPLICATIONS

This application is a Continuation-in-Part of U.S. application Ser. No. 14/011,202 entitled "Lightweight Polymer Ammunition Cartridge Casings" filed on Aug. 27, 2013, which is a Divisional of U.S. patent application Ser. No. 13/292,843 entitled "Lightweight Polymer Ammunition Cartridge Casings" filed on Nov. 9, 2011 which issued as U.S. Pat. No. 8,561,543 on Oct. 22, 2013, which claims priority to U.S. Provisional Application Ser. No. 61/456,664 entitled "Polymer Case Ammunition and Methods of Manufacturing the Same (diffuser and exacter insert)" filed on Nov. 10, 2010. The contents of which are incorporated by reference in their entirety.

TECHNICAL FIELD OF THE INVENTION

The present invention relates in general to the field of ammunition, specifically to lightweight polymer ammunition having a primer having a diffuser.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with primers for polymer cartridge casing ammunition. Conventional ammunition cartridge casings for rifles and machine guns, as well as larger caliber weapons, are made from brass, which is heavy, expensive, and potentially hazardous. There exists a need for an affordable lighter weight replacement for brass ammunition cartridge cases that can increase mission performance and operational capabilities. Lightweight polymer cartridge casing ammunition must meet the reliability and performance standards of existing fielded ammunition and be interchangeable with brass cartridge casing ammunition in existing weaponry. Reliable cartridge casing manufacturing requires uniformity (e.g., bullet seating, bullet-to-casing fit, casing strength, etc.) from one cartridge to the next in order to obtain consistent pressures within the casing during firing prior to bullet and casing separation to create uniformed ballistic performance. Plastic cartridge casings have been known for many years but have failed to provide satisfactory ammunition that could be produced in commercial quantities with sufficient safety, ballistic, handling characteristics, and survive physical and natural conditions to which it will be exposed during the ammunition's intended life cycle; however, these characteristics have not been achieved. Shortcomings of the known plastic or substantially plastic ammunition include the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing or insufficient sealing about the primer. To overcome the above shortcomings, improvements in cartridge case design and performance polymer materials are needed.

BRIEF SUMMARY OF THE INVENTION

The present invention provides a method of making a polymeric ammunition having a primer inserted into a diffuser cup comprising the steps of: providing a substantially cylindrical insert comprising a top surface opposite a bottom surface and a substantially cylindrical coupling element that extends from the bottom surface to form a circumferential surface, a primer recess in the top surface that extends toward the bottom surface, a primer flash hole aperture positioned in the primer recess to extend through the bottom surface, and a flange that extends circumferentially about an outer edge of the top surface; forming a substantially cylindrical polymeric middle body comprising the steps of overmolding a polymer composition over the substantially cylindrical insert by molding the polymer composition over the substantially cylindrical coupling element, over the circumferential surface and into the primer flash hole aperture to form a primer flash hole, forming a substantially cylindrical polymeric middle body extending from the substantially cylindrical insert, and forming a substantially cylindrical polymeric coupling end at the end of the substantially cylindrical polymeric middle body; forming a substantially cylindrical open-ended polymeric bullet-end component comprising the steps of forming a polymeric bullet-end coupling component opposite a bullet-end aperture from a second polymer composition, wherein the polymeric bullet-end coupling component mates to the substantially cylindrical polymeric coupling end; adhering the polymeric bullet-end coupling component mates to the substantially cylindrical polymeric coupling end to form a propellant chamber having a bullet-end aperture opposite a primer flash hole; forming a diffuser cup adapted to hold a primer comprising a bottom surface sized to fit in the primer recess, a diffuser aperture positioned through the bottom surface and aligned with the primer flash hole, a cup wall attached to the bottom surface and extending away from the bottom surface, and an interior cavity bordered by the cup wall and the bottom surface and sized to frictionally fit the primer; inserting a primer into the diffuser cup; at least partially filling the propellant chamber with a propellant; and frictionally fitting a bullet in the bullet-end aperture, wherein the primer, the propellant and the bullet form a propellant chamber.

The substantially cylindrical open-ended polymeric bullet-end component may have a shoulder positioned between the substantially cylindrical polymeric bullet-end and the bullet-end aperture. The substantially cylindrical open-ended polymeric bullet-end component may have a neck positioned between the bullet-end aperture and the shoulder. The substantially cylindrical open-ended polymeric bullet-end component, substantially cylindrical polymeric middle body or both may be formed from a ductile polymer. The substantially cylindrical open-ended polymeric bullet-end component may be formed from a less ductile polymer than the substantially cylindrical polymeric middle body. The substantially cylindrical open-ended polymeric bullet-end component, substantially cylindrical polymeric middle body or both may include a nylon polymer. The substantially cylindrical open-ended polymeric bullet-end component, substantially cylindrical polymeric middle body or both may be formed from a fiber-reinforced polymeric composite. The fiber-reinforced polymeric composite may include between about 5 and about 70 wt % glass fiber fillers, mineral fillers, or mixtures thereof. The substantially cylindrical open-ended polymeric bullet-end component may be welded or bonded to the substantially cylindrical polymeric middle body. The bullet-end aperture may be welded or bonded to the bullet. The bullet-end aperture may be crimped to the bullet. The bullet may be adhesively fitted to the bullet-end aperture. The bullet-end aperture or the neck may have one or more cannelures that interlocks with the bullet. The forward opening end may have one, two, three, or more annular rings that mate with one, two, three, or more corresponding annular grooves positioned on the bullet. The substantially cylindrical polymeric middle body may be a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The substantially cylindrical open-ended polymeric bullet-end component may be a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The substantially cylindrical open-ended polymeric bullet-end component may have a neck with a plurality of internal structures for supporting a bullet. The substantially cylindrical coupling element may be a male coupling element with a straight skirt interlock surface that tapers to a smaller diameter at the forward portion on the skirt tip to mate with a female coupling element of the substantially cylindrical polymeric coupling end. The polymeric ammunition may include a diffuser positioned in the primer recess in contact with the primer and comprising a diffuser flash hole aligned with the primer flash hole. The fiber-reinforced polymeric composite may contain between about 5 wt %, 6 wt %, 7 wt %, 8 wt %, 9 wt %, 10 wt %, 11 wt %, 12 wt %, 13 wt %, 14 wt %, 15 wt %, 16 wt %, 17 wt %, 18 wt %, 19 wt %, 20 wt %, 21 wt %, 22 wt %, 23 wt %, 24 wt %, 25 wt %, 26 wt %, 27 wt %, 28 wt %, 29 wt %, 30 wt %, 31 wt %, 32 wt %, 33 wt %, 34 wt %, 35 wt %, 36 wt %, 37 wt %, 38 wt %, 39 wt %, 40 wt %, 41 wt %, 42 wt %, 43 wt %, 44 wt %, 45 wt %, 46 wt %, 47 wt %, 48 wt %, 49 wt %, 50 wt %, 51 wt %, 52 wt %, 53 wt %, 54 wt %, 55 wt %, 56 wt %, 57 wt %, 58 wt %, 59 wt %, 60 wt %, 61 wt %, 62 wt %, 63 wt %, 64 wt %, 65 wt %, 66 wt %, 67 wt %, 68 wt %, 69 wt % or 70 wt % glass fiber fillers, mineral fillers, or mixtures thereof.

BRIEF DESCRIPTION OF THE SEVERAL VIEWS OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
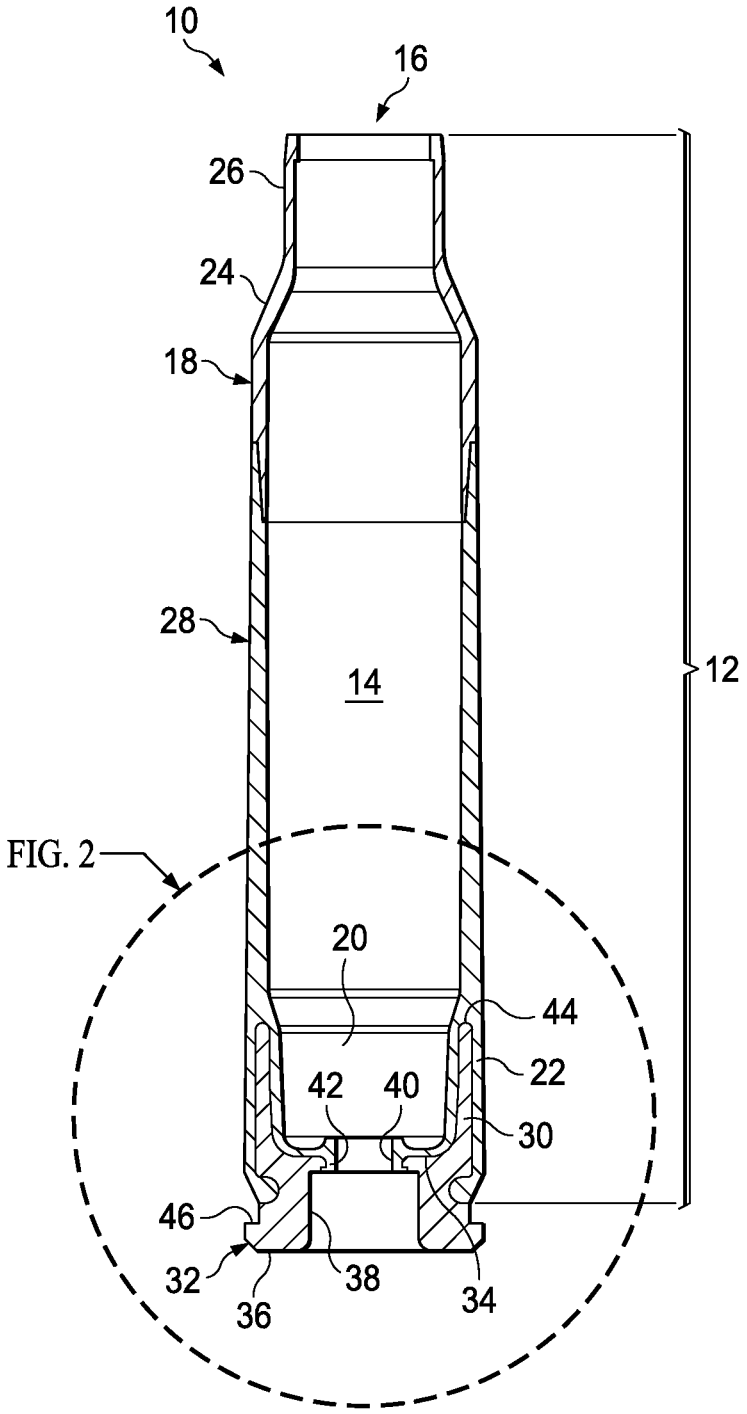
FIG. 1 depicts an exploded view of the polymeric cartridge casing.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

As used herein, the term "ammunition", "ammunition article", "munition", and "munition article" as used herein may be used interchangeably to refer to a complete, assembled round or cartridge that is ready to be loaded into a firearm and fired, including cap, casing, propellant, projectile, etc. Ammunition may be a live round fitted with a projectile, or a blank round with no projectile and may also be other types such as non-lethal rounds, rounds containing rubber bullets, rounds containing multiple projectiles (shot), and rounds containing projectiles other than bullets such as fluid-filled canisters and capsules. Ammunition may be any caliber of pistol or rifle ammunition, e.g., non limiting examples include 0.22, 0.22-250, 0.223, 0.243, 0.25-06, 0.270, 0.300, 0.30-30, 0.30-40, 30.06, 0.300, 0.303, 0.308, 0.338, 0.357, 0.38, 0.380, 0.40, 0.44, 0.45, 0.45-70, 0.50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm and others.

As used herein, the term "casing" and "case" and "body" are used interchangeably (e.g., "cartridge casing", "cartridge case" and "casing body") to refer to the portion of the ammunition that remains intact after firing and includes the propellant chamber and may include the primer insert. A cartridge casing may be one-piece, two-piece, three-piece or multi-piece design that includes a mouth at one end and a primer insert at the other separated by a propellant chamber.

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 5.56 mm, 7.62 mm and .50 caliber ammunition cartridges, as well as medium/small caliber ammunition such as 380 caliber, 38 caliber, 9 mm, 10 mm, 20 mm, 25 mm, 30 mm, 40 mm, 45 caliber and the like. The cartridges, therefore, are of a caliber between about .05 and about 5 inches. Thus, the present invention is also applicable to the sporting goods industry for use by hunters and target shooters.

A traditional cartridge casing generally has a deep-drawn elongated body with a primer end and a projectile end. During use, a weapon's cartridge chamber supports the majority of the cartridge casing wall in the radial direction, however, in many weapons, a portion of the cartridge base end is unsupported. During firing, the greatest stresses are concentrated at the base end of the cartridge, which must have great mechanical strength. This is true for both subsonic and supersonic ammunition cartridges.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing.

Firing pin-initiated primers are employed in ammunition primarily for initiation of the powder charge. A firing pin-initiated primer or percussion cap consists of a pressed or cast impact-sensitive charge of a known type, a so-called anvil which abuts against the sides of the primer charge which face in the initiation direction thereof, that is towards the main or propellant charge which is to be initiated by the primer, and a protective case or capsule surrounding the other sides of the primer charge and consisting of at least partly deformable material. The surface of the primer charge facing the anvil may also be covered by a readily destructible protective foil which, as a rule, mainly has a moisture-protective function. On the initiation of the primer, the casing is, thus, to be deformed by a firing pin opposite the anvil so that the primer charge which is compressed between the anvil and the deformed case, is initiated. In the primer designs most commonly employed today, the anvil, consists of a bent sheet bridge with gaps on either side thereof in order that the flame jets from the initiated primer charge will be able to reach the main or propellant charge. The anvil consists of a metal body perforated by some means for the passage of the flame jets. The drawback inherent in both of these basic types of anvil is that they leave greater or smaller parts of the upper surface of the primer charge wholly without support, either in the form of gaps beside the anvil or perforations through the anvil.

The present invention is a diffuser that adapts a primer to a polymer cartridge. Generally, the ammunition cartridge includes a polymer cartridge that has been overmolded over a metal primer insert that includes a primer recess. The present diffuser is adapted to fit between the primer recess and abut the interior wall of the primer recess to separate the primer from the bottom wall of the primer recess. In another embodiment, the diffuser is adapted to fit in the primer recess and abut both the side wall and the bottom wall of the primer recess to separate the primer from the walls of the primer recess.

FIG. 1 depicts an exploded view of the polymeric cartridge casing. A cartridge 10 is shown with a polymer casing 12 showing a propellant chamber 14 with a forward end opening 16 for insertion of a projectile (not shown). Polymer casing 12 has a substantially cylindrical open-ended polymeric bullet-end component 18 extending from forward end opening 16 rearward to opposite end 20. The bullet-end component 18 may be formed with coupling end 22 formed on opposite end 20. Coupling end 22 is shown as a female element, but may also be configured as a male element in alternate embodiments of the invention. The forward end of polymeric bullet-end component 18 has a shoulder 24 forming chamber neck 26. Polymer casing 12 has a substantially cylindrical opposite end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages cylindrical coupling element 30 of a substantially cylindrical insert 32. The substantially cylindrical insert 32 includes a substantially cylindrical coupling element 30 extending from a bottom surface 34 that is opposite a top surface 36. When contacted the coupling end 22 interlocks with the substantially cylindrical coupling element 30, through the coupling element 30 that extends with a taper to a smaller diameter at the tip 44 to form a cylindrical physical interlock between substantially cylindrical insert 32 and middle body component 28. The substantially cylindrical insert 32 also has a flange 46 cut therein and a primer recess 38 and primer flash hole aperture 42 formed therein for ease of insertion of the primer (not shown). A primer flash hole aperture 42 is located in the primer recess 38 and extends through the bottom surface 34 into the propellant chamber 14 to combust the propellant in the propellant chamber 14. When molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42.

Figure 2:
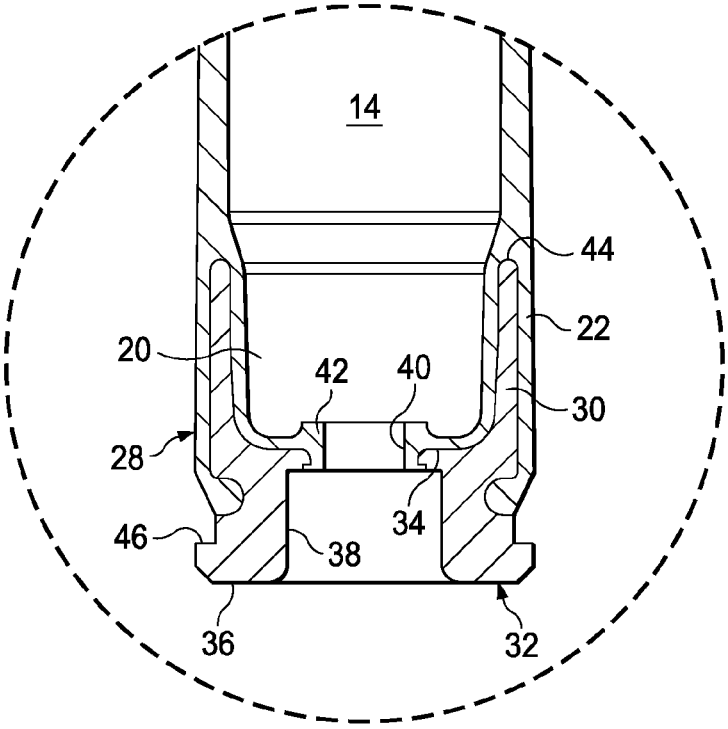
FIG. 2 depicts a side, cross-sectional view of a portion of the polymeric cartridge case according to one embodiment of the present invention.

FIG. 2 depicts a side, cross-sectional view of a portion of the polymeric cartridge case according to one embodiment of the present invention. A portion of a cartridge suitable for use with high velocity rifles is shown manufactured with a polymer casing 12 showing a propellant chamber 14. Polymer casing 12 has a substantially cylindrical opposite end 20. The polymer bullet-end component 18 may be formed with coupling end 22 formed on opposite end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 38 and extends through the bottom surface 34 into the propellant chamber 14. The coupling end 22 extends the polymer through the primer flash hole 40 to form primer flash hole aperture 42 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28.

Figure 3:
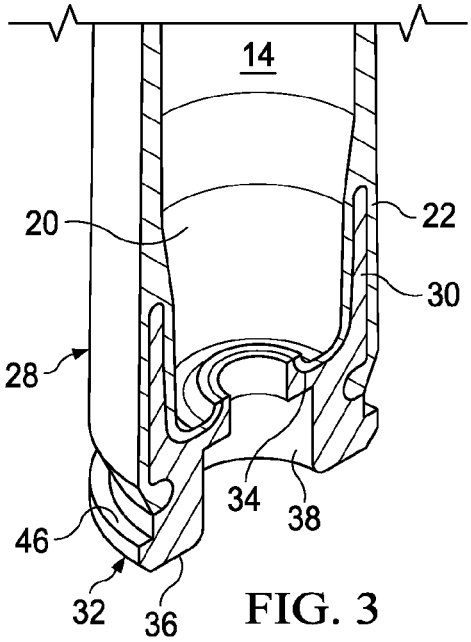
FIG. 3 depicts a side, cross-sectional view of a portion of the polymeric cartridge case lacking the aperture coating.

FIG. 3 depicts a side, cross-sectional view of a portion of the polymeric cartridge case lacking the aperture coating (not shown). A portion of a cartridge suitable for use with high velocity rifles is shown manufactured with a polymer casing 12 showing a propellant chamber 14. Polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 38 and extends through the bottom surface 34 into the propellant chamber 14. The coupling end 22 extends the polymer through the primer flash hole 40 to form an aperture coating 42 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28.

Figure 4:
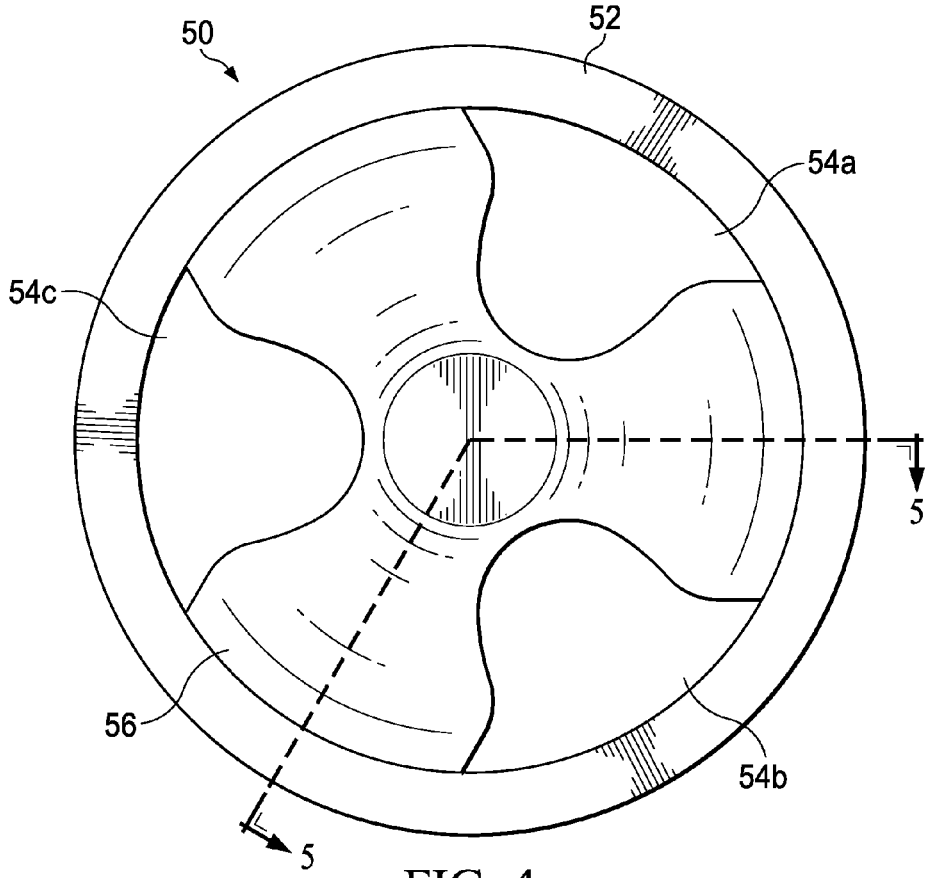
FIG. 4 is a top plan view of a general primer.

FIG. 4 depicts a top view of a primer 50. The primer 50 includes the cup 52 having a retaining means 54*a*, 54*b* and 54*c* and anvil 56.

Figure 5:
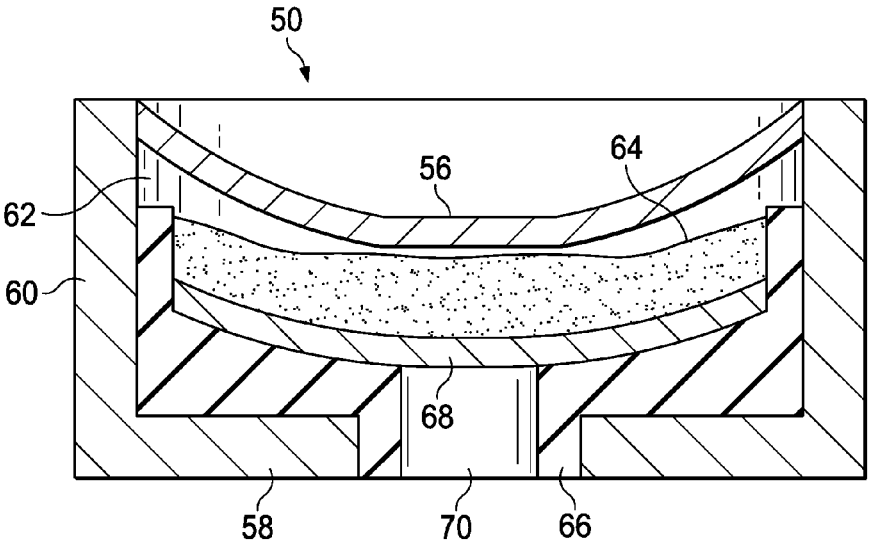
FIG. 5 depicts a cross-sectional elevation view taken along line 2-2 of the primer in FIG. 4.

FIG. 5 depicts a cross-sectional elevation view taken along line 2-2 of the primer 50 in FIG. 4. The primer 50 includes the cup 52 having a bottom 58 and side wall 60 that forms an internal cavity 62 that houses an explosive charge 64. The cup 52 is sized to frictionally fit a primer aperture (not shown). An insulating liner 66 is positioned within the cup 50 separating the cup 50 from the contact 68. A button 70 is positioned in the bottom 58 surrounded by the insulating liner 66 and contacting the contact 68. When a firing pin strikes the primer 50 and crushed the button 70 against the anvil 56, the highly reactive explosive charge is initiated by the button 70 to produce a high velocity flame that extends into the flash hole (not shown) and contacts the propellant (not shown). This is only one embodiment of a primer 50 that may be used with the present invention and any primer 50 may be used.

Figure 6A:
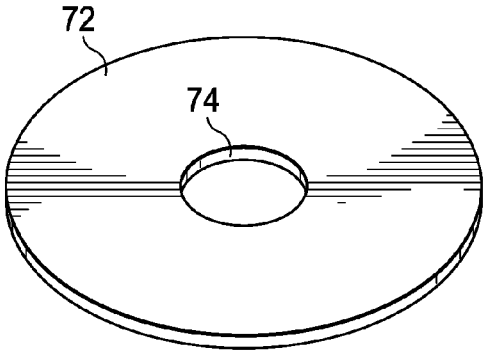
FIGS. 6*a* and 6*b* are images of a diffuser adapter.
Figure 6B:
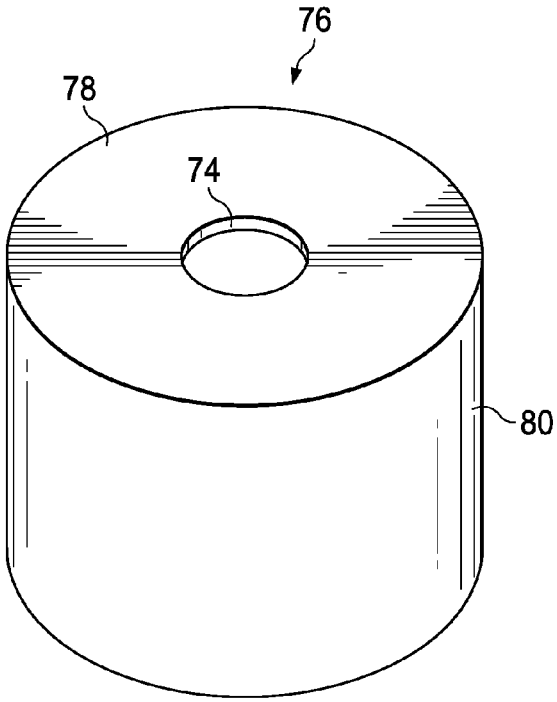

FIGS. 6*a* and 6*b* are images of a diffuser adapter. FIG. 6*a* is an image of a diffuser ring 72 that is placed between the primer (not shown) and the bottom of the primer recess (not shown). The diffuser ring 72 includes a diffuser aperture 74 that aligns with the flash hole (not shown) and the primer (not shown). FIG. 6*b* is an image of a diffuser cup 76 that covers (or at least partially covers) the primer (not shown) and fits in the primer recess (not shown). The diffuser cup 76 includes bottom surface 78 that includes a diffuser aperture 74 that aligns with the flash hole (not shown) and a cup wall 80 that attaches to the bottom surface 78 to cover the primer (not shown).

Figure 7:
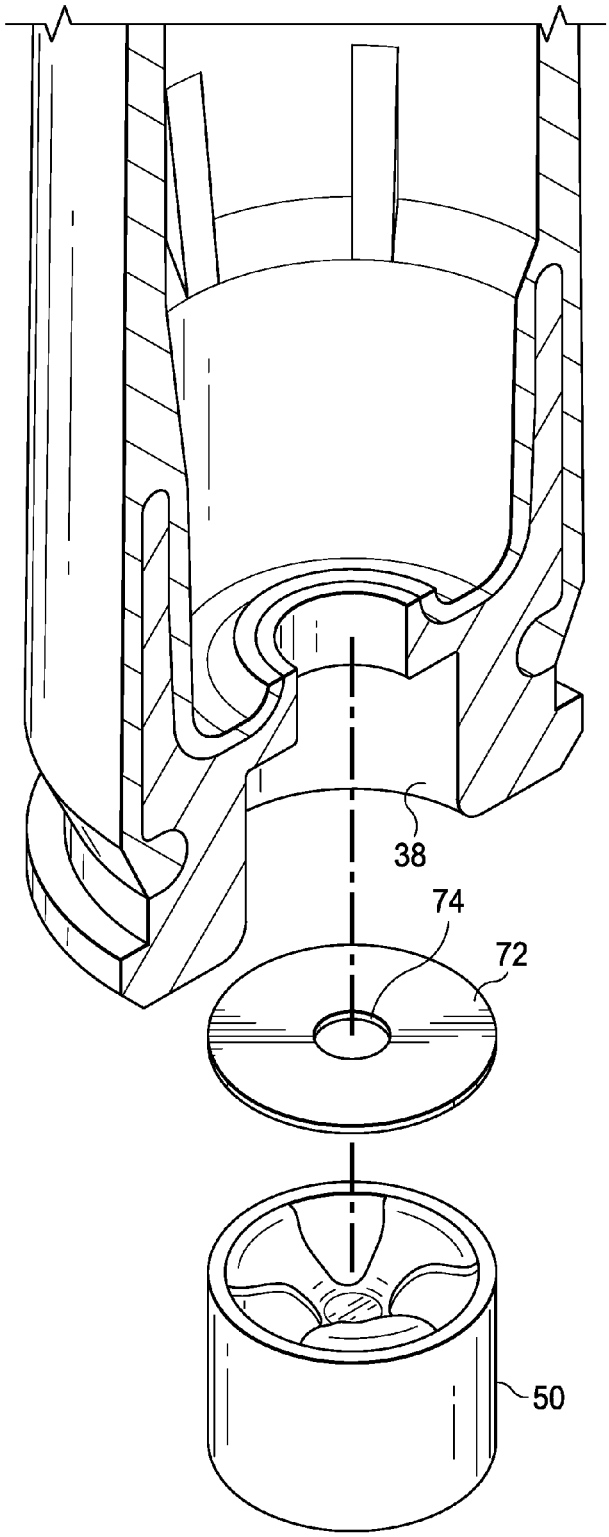
FIG. 7 is an exploded image of the diffuser ring that is placed between the primer and the bottom of the primer recess.

FIG. 7 is an exploded image of the diffuser ring 72 that is placed between the primer 50 and the bottom of the primer recess 38. The diffuser ring 72 includes a diffuser aperture 74 that aligns with the flash hole (not shown) and the primer 50.

Figure 8:
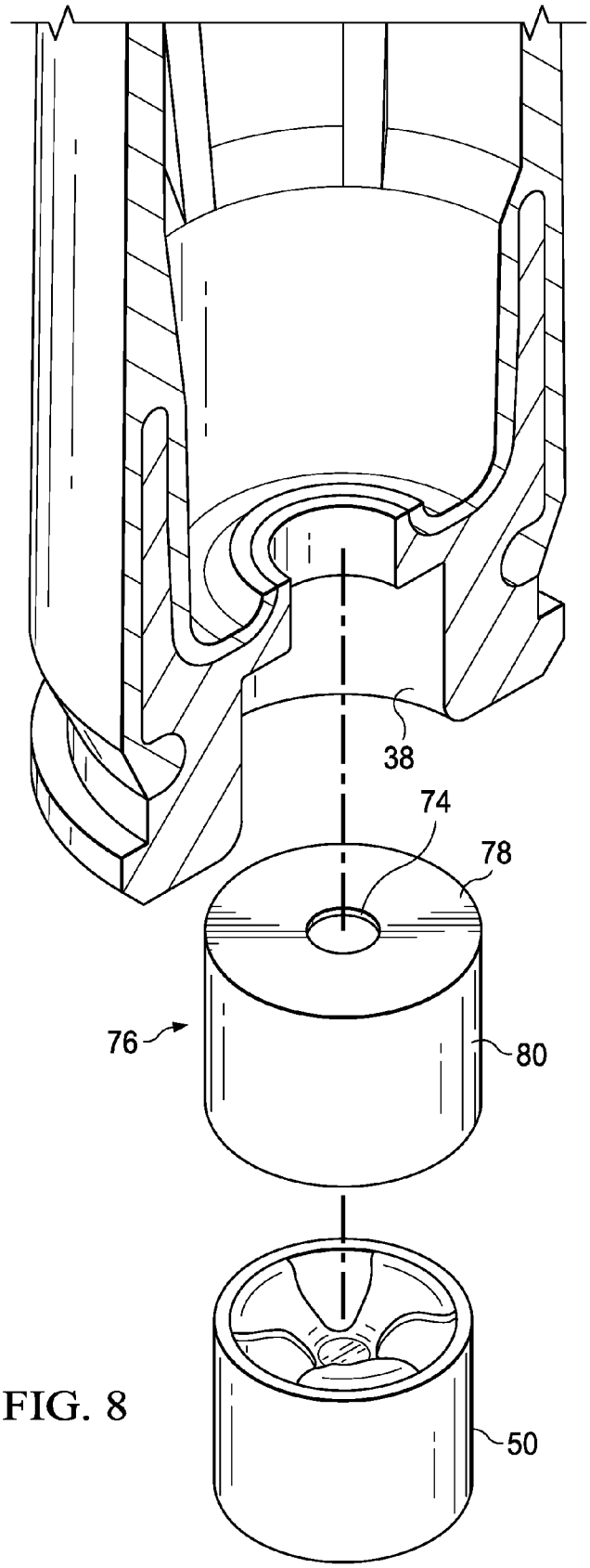
FIG. 8 is an exploded image of the diffuser cup that at least partially covers the primer and fits in the primer recess.

FIG. 8 is an exploded image of the diffuser cup 76 that covers (or at least partially covers) the primer 50 and fits in the primer recess 38. The diffuser cup 76 includes bottom surface 78 that includes a diffuser cup aperture 74 that aligns with the flash hole (not shown) of the primer recess 38. The diffuser cup 76 includes a cup wall 80 that attaches to the bottom surface 78 to cover the primer 50.

Figure 9:
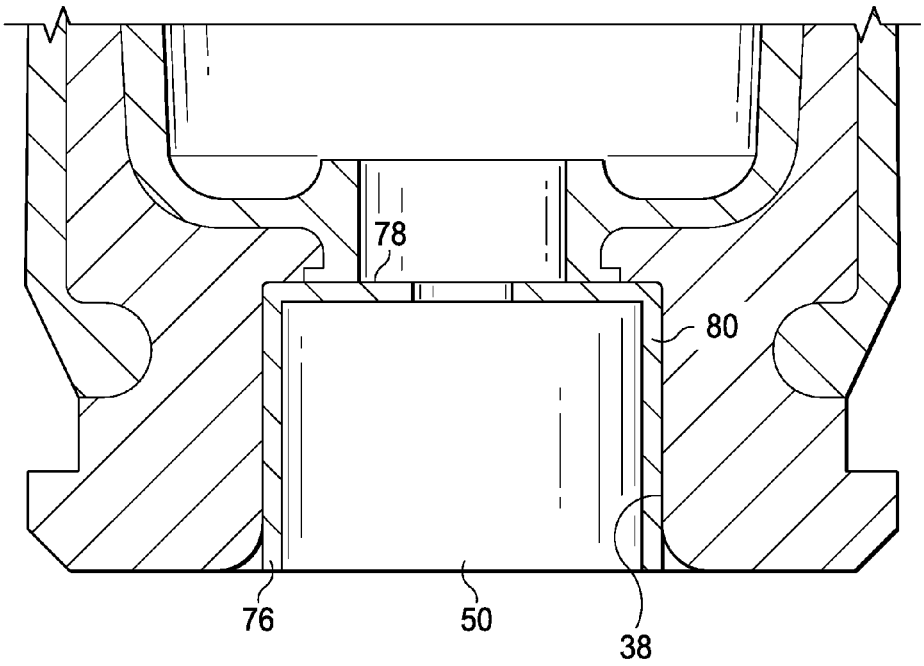
FIG. 9 is a cut away image of the diffuser cup that at least partially covers the primer and fits in the primer recess.

FIG. 9 is a cut away image of the diffuser cup 76 that covers (or at least partially covers) the primer 50 and fits in the primer recess 38. The diffuser cup 76 includes bottom surface 78 that includes a diffuser aperture 74 that aligns with the flash hole (not shown) of the primer recess 38. The diffuser cup 76 includes a cup wall 80 that attaches to the bottom surface 78 to cover the primer 50. The diffuser cup 76 and the diffuser ring 72 may be made of a metal or alloy or a polymer composition and may be combined with some form of suitable sealant. This seal may possibly be improved by a sealant or by pressing the anvil against the diffuser cup or the diffuser ring.

The components may be formed from high-strength polymer, composite metal, alloys or ceramic. Examples of suitable high strength polymers include composite polymer material including a tungsten metal powder, nylon 6/6, nylon 6, and glass fibers; and a specific gravity in a range of 3-10. The tungsten metal powder may be 50%-96% weight. The polymer materials also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The composition may be made of a modified ZYTEL® resin, available from E.I. DuPont De Nemours Co., a modified 612 nylon resin, modified to increase elastic response. Examples of suitable polymers include polyurethane prepolymer, cellulose, fluoro-polymer, ethylene interpolymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyarylsulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 weight percent, and preferably up to about 65 weight percent of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers may have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Commercially available polymers suitable for use in the present invention thus include polyphenylsulfones; copolymers of polyphenylsulfones with polyether-sulfones or polysulfones; copolymers and blends of polyphenylsulfones with polysiloxanes; poly (etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL® R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

One of ordinary skill in the art will know that many propellant types and weights can be used to prepare workable ammunition and that such loads may be determined by a careful trial including initial low quantity loading of a given propellant and the well-known stepwise increasing of a given propellant loading until a maximum acceptable load is achieved. Extreme care and caution is advised in evaluating new loads. The propellants available have various burn rates and must be carefully chosen so that a safe load is devised.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

What is claimed is:

1. A method of making a polymeric ammunition having a primer inserted into a diffuser cup comprising the steps of:

providing a substantially cylindrical insert comprising a top surface opposite a bottom surface and a substantially cylindrical coupling element that extends from the bottom surface to form a circumferential surface, a primer recess in the top surface that extends toward the bottom surface, a primer flash hole aperture positioned in the primer recess to extend through the bottom surface, and a flange that extends circumferentially about an outer edge of the top surface;

forming a substantially cylindrical polymeric middle body comprising the steps of overmolding a polymer composition over the substantially cylindrical insert by molding the polymer composition over the substantially cylindrical coupling element, over the circumferential surface and into the primer flash hole aperture to form a primer flash hole, forming a substantially cylindrical polymeric middle body extending from the substantially cylindrical insert, and forming a substantially cylindrical polymeric coupling end at the end of the substantially cylindrical polymeric middle body;

forming a substantially cylindrical open-ended polymeric bullet-end component comprising the steps of forming a polymeric bullet-end coupling component opposite a bullet-end aperture from a second polymer composition, wherein the polymeric bullet-end coupling component mates to the substantially cylindrical polymeric coupling end;

adhering the polymeric bullet-end coupling component to the substantially cylindrical polymeric coupling end to form a propellant chamber having a bullet-end aperture opposite a primer flash hole;

forming a diffuser cup adapted to hold a primer comprising a bottom surface sized to fit in the primer recess, a diffuser aperture positioned through the bottom surface and aligned with the primer flash hole, a cup wall attached to the bottom surface and extending away from the bottom surface, and an interior cavity bordered by the cup wall and the bottom surface and sized to frictionally fit the primer;

inserting a primer into the diffuser cup;

at least partially filling the propellant chamber with a propellant; and frictionally fitting a bullet in the bullet-end aperture, wherein the primer, the propellant and the bullet form a propellant chamber.

2. The method of claim 1, wherein the substantially cylindrical open-ended polymeric bullet-end component comprises a shoulder positioned between the substantially cylindrical polymeric bullet-end and the bullet-end aperture and a neck positioned between the shoulder and the bullet-end aperture.

3. The method of claim 1, wherein the substantially cylindrical open-ended polymeric bullet-end component, substantially cylindrical polymeric middle body or both are formed from a ductile polymer.

4. The method of claim 1, wherein the substantially cylindrical open-ended polymeric bullet-end component is formed from a less ductile polymer than the substantially cylindrical polymeric middle body.

5. The method of claim 1, wherein the substantially cylindrical open-ended polymeric bullet-end component, substantially cylindrical polymeric middle body or both comprise a nylon polymer.

6. The method of claim 1, wherein the substantially cylindrical open-ended polymeric bullet-end component, substantially cylindrical polymeric middle body or both are formed from a fiber-reinforced polymeric composite.

7. The method of claim 6, wherein the fiber-reinforced polymeric composite contains between about 5 and about 70 wt % glass fiber fillers, mineral fillers, or mixtures thereof.

8. The method of claim 1, wherein the polymeric bullet-end coupling component is welded or bonded to the substantially cylindrical polymeric coupling end.

9. The method of claim 1, wherein the bullet-end aperture is welded or bonded to the bullet.

10. The method of claim 1, wherein the bullet-end aperture comprises one or more cannelures that interlocks with the bullet.

11. The method of claim 1, wherein the substantially cylindrical open-ended polymeric bullet-end component further comprises a neck located between the polymeric bullet-end coupling component and the bullet-end aperture and a shoulder located between the neck and the polymeric bullet-end coupling component, wherein the neck comprises one or more cannelures that interlocks with the bullet.

12. The method of claim 1, wherein the forward opening end comprises one, two, three, or more annular rings that mate with one, two, three, or more corresponding annular grooves positioned on the bullet.

13. The method of claim 1, wherein the polymer composition and the second polymer composition independently comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

14. The method of claim 1, wherein the substantially cylindrical open-ended polymeric bullet-end component comprises a neck with a plurality of internal structures for supporting a bullet.

15. The method of claim 1, wherein the substantially cylindrical coupling element is a male coupling element with a straight skirt interlock surface that tapers to a smaller diameter at the forward portion on the skirt tip to mate with a female coupling element of the substantially cylindrical polymeric coupling end.

* * * * *